US007197878B2

(12) United States Patent
Gainford

(10) Patent No.: US 7,197,878 B2
(45) Date of Patent: Apr. 3, 2007

(54) PUMP CONTROL SYSTEM

(75) Inventor: David M Gainford, Sutton Coldfield (GB)

(73) Assignee: Rolls-Royce plc, London (GB)

( * ) Notice: Subject to any disclaimer, the term of this patent is extended or adjusted under 35 U.S.C. 154(b) by 243 days.

(21) Appl. No.: 10/829,441

(22) Filed: Apr. 22, 2004

(65) Prior Publication Data

US 2004/0231314 A1 Nov. 25, 2004

(30) Foreign Application Priority Data

May 9, 2003 (GB) ..... 0310643.2

(51) Int. Cl.
*F02C 9/28* (2006.01)

(52) U.S. Cl. ..... 60/773; 60/89.281; 417/20; 417/22

(58) Field of Classification Search ..... 60/39.281, 60/734, 773; 417/20, 22, 42, 43
See application file for complete search history.

(56) References Cited

U.S. PATENT DOCUMENTS 3,908,360 A * 9/1975 Meyer et al. ..... 60/39.281
3,981,287 A 9/1976 Williams
4,004,412 A * 1/1977 Burnell ..... 60/39.281
4,795,314 A 1/1989 Prybella
4,815,278 A * 3/1989 White ..... 60/39.281
6,182,438 B1 * 2/2001 Weber ..... 60/778

FOREIGN PATENT DOCUMENTS

| | | |
|---|---|---|
| EP | 270474 A | 6/1988 |
| EP | 1138950 A | 3/2000 |
| GB | 1449852 P | 9/1976 |
| GB | 2156544 A | 10/1985 |

* cited by examiner

*Primary Examiner*—L. J. Casaregola
(74) *Attorney, Agent, or Firm*—W. Warren Taltavull; Manelli Denison & Selter PLLC

(57) ABSTRACT

A pump control system (20) for a pump (21) in a gas turbine engine (10) is described. The pump control system (20) comprises demand means (22) for providing a demand signal (23) relating to a required rate of fluid flow and/or pressure from the pump (21). The system also comprises sensing means (26) to sense at least one parameter of fluid downstream of the pump (21) and to provide at least one feedback signal (28) relating to the, or each, respective parameter. Comparator means (30) is provided for comparing the demand signal (23) with the, or at least one, feedback signal to provide a control signal (33) for controlling the pump.

36 Claims, 2 Drawing Sheets

PUMP CONTROL SYSTEM

FIELD OF THE INVENTION

This invention relates to pump control systems. More particularly, but not specifically, the invention relates to fuel pump control systems, for example in engines such as gas turbine engines.

BACKGROUND OF THE INVENTION

In general engines require fuel to be pumped to one or more combustion chambers under controlled conditions, depending on the requirements of the engine. Any variation in the pressure or rate of flow of the fuel for a particular engine requirement can result in combustion instability and physical deterioration of system and engine components. Such instability can result in significant problems in the engines.

SUMMARY OF THE INVENTION

According to one aspect of this invention there is provided a pump control system comprising demand means for providing a demand signal relating to pump speed, a required rate of fluid flow and/or pressure from a pump, and compensation means to modify the signal to render the signal suitable to affect functioning of the pump.

Preferably, the control system comprises sensing means to sense pump speed, or at least one parameter of fluid downstream of the pump. The sensing means may provide at least one feedback signal relating to the, or each, respective parameter. The system desirably comprises comparator means for comparing the demand signal with the, or at least one, feedback signal to provide a control signal to control the pump.

In the preferred embodiment, the compensation means modifies the demand signal so that, in combination with the transfer function of the pump a desired output is provided from the pump.

As used herein the expression "transfer function" is intended to refer to the relationship between the behaviour of the output of a feature and the behaviour of the input of the feature.

As used herein, the expression "compensate" is intended to refer to a modification process, which could include a conversion from one physical medium to another, for example a conversion from electrical current to torque, or a conversion from position to volts.

According to another aspect of this invention, there is provided a pump control system comprising demand means for providing a demand signal relating to a required pump speed, rate of fluid flow and/or pressure from a pump; sensing means to sense pump speed or at least one parameter of fluid downstream of the pump and to provide at least one feedback signal relating to the, or each, respective parameter; and comparator means for comparing the demand signal with the, or at least one, feedback signal to provide a control signal to control the pump.

Preferably, the control signal is determined by the demand signal and the, or at least one, feedback signal. The sensing means may comprise a plurality of sensors, each sensing a respective parameter of pump and/or the fluid, and/or where the system is used in an engine, each sensing a respective parameter of the engine. Preferably the comparator means comprises a primary comparator for comparing a first feedback signal with the demand signal and providing a primary control signal. The comparator means may further include a secondary comparator for comparing one or more secondary feedback signals with the primary control signal to provide a secondary control signal.

The primary comparator may provide a primary control signal for controlling the pump. In one embodiment, the primary comparator may subtract the first feedback signal from the demand signal to provide said primary control signal.

Conveniently, the sensing means comprises a sensor arrangement to sense either pump speed, fluid pressure, and/or the rate of flow of pumped fluid downstream of the pump. Preferably, the sensor arrangement provides first and second feedback signals relating to pump speed, fluid pressure, or to the rate of flow of the fluid.

The sensor arrangement may comprise a first feedback signal compensation means to provide compensation to the first feedback signal to modify the first feedback signal and render the first feedback signal into a form whereby it can be supplied to the first comparator. A further compensation means may modify one or more further feedback signals for use by a second comparator.

Preferably, the demand signal provided by the demand means relates to the required rate of fluid flow, the required pump speed, or the required fluid pressure.

The sensing means may comprise a speed sensor to sense the speed of the pump. Preferably, the speed sensor provides a feedback signal relating to the speed of the pump.

Alternatively, or in addition, the sensing means may comprise a pressure sensor and/or a flow sensor to sense the conditions of pumped fluid downstream of the pump.

Preferably, the pressure and/or the flow sensor provides one or more feedback signals relating respectively to the pressure and/or flow of the fluid.

The sensing means may comprise feedback compensation means to provide compensation to the, or each, feedback signal to modify the, or each, feedback signal and render it into a form whereby it can be supplied to the comparator means.

Preferably, the fluid to be pumped is a fuel, to be combusted in a combustion chamber and produce combustion gases. The sensing means may comprise at least one combustion gas sensor to sense conditions of the combusted gases in, or downstream of, the combustion chamber. Preferably, the combustion gas sensor provides a combustion gas feedback signal relating to a parameter of the combustion gases.

The control system may comprise combustion gas feedback compensation means to provide compensation to the combustion gas feedback signal to modify the combustion gas feedback signal and render it into a form whereby it can be supplied to the comparator means.

The secondary comparator may compare the primary control signal with one or both of the modified secondary pump feedback signal and the modified combustion gas feedback signal. Preferably, the secondary comparator provides a secondary control signal for controlling the pump. In one embodiment, the secondary comparator may subtract from the primary control signal one or both of the modified pressure feedback signal and the modified combustion gas feedback signal. In another embodiment, the secondary comparator may comprise a plurality of comparators, one of which is operable on a combustion gas feedback signal, and the, or each, other of which is operable on the secondary pump feedback signal.

The control system may include configurations where one or more of the feedback signals described above is not incorporated.

According to another aspect of this invention there is provided a pump arrangement, comprising a pump to pump a fluid, and a pump control system as described above.

Desirably, the pump is configured to provide a characteristic speed, pressure and/or rate of flow when provided within an input control signal. Preferably, variations in the control signal cause concomitant variations in the speed, pressure and/or rate of fluid flow pumped from the pump.

BRIEF DESCRIPTION OF THE DRAWINGS

An embodiment of the invention will now be described by way of example only, with reference to the accompanying drawing, in which.

DETAILED DESCRIPTION OF THE INVENTION

Figure 1:
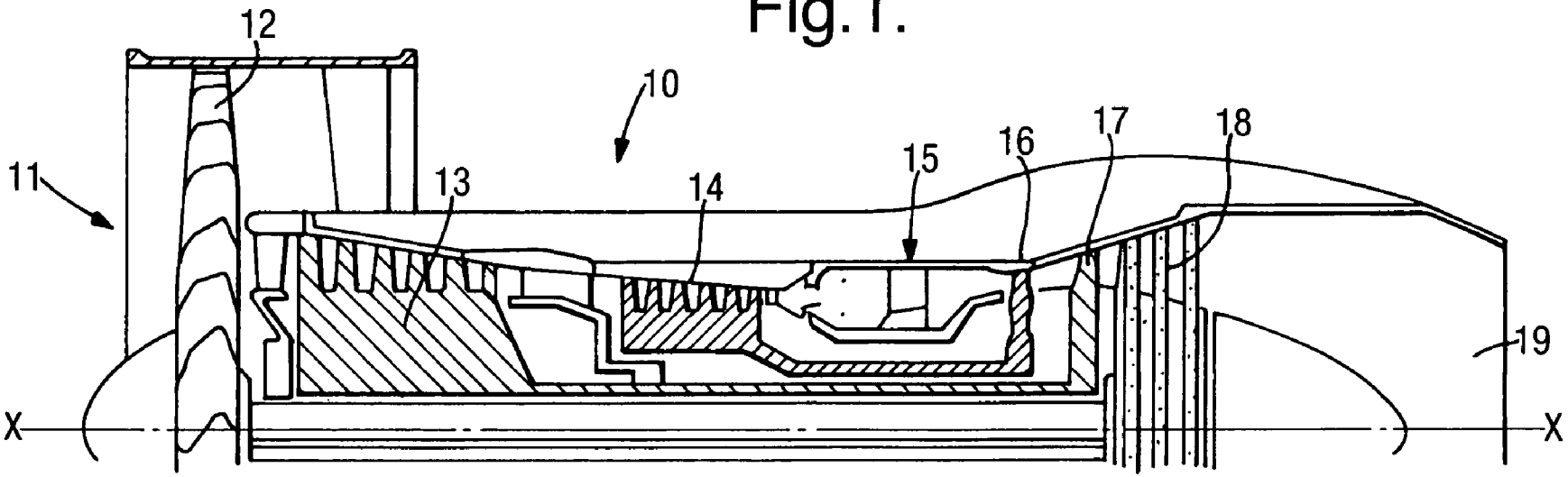
FIG. 1 is a cross-sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15 a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression take place.

The compressed air exhausted from the high pressure compressor 14 is directed into the combustor 15 where it is mixed with fuel and the mixture combusted. The resultant hot combustion products then expand through and thereby drive the high, intermediate and low pressure turbines 16, 17 and 18, before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

In order to control the flow of fuel to the combustor 15 a pump is provided. A pump control system 20 is shown diagrammatically in FIG. 2.

Figure 2:
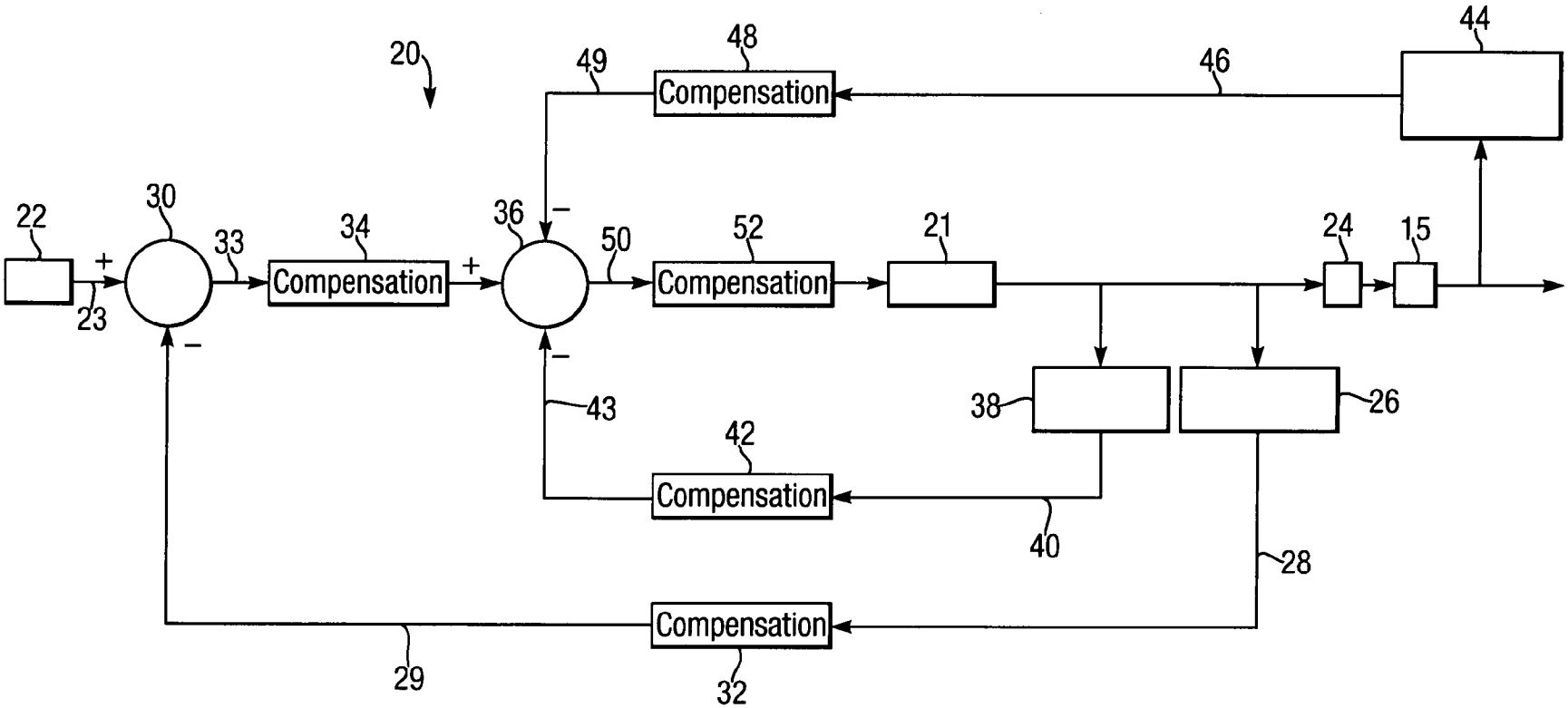
FIG. 2 is a schematic diagram of a control system for a pump.

Referring to FIG. 2, the control system 20 for a pump 21 is shown which comprises demand means 22 for providing a demand signal 23, relating to a required speed for the pump 21. Fuel from the pump may flow through a fuel metering system 24 to the combustor 15. The demand means could be suitable electronic or mechanical devices connected to the control lever for the gas turbine engine 10 which is designed to produce predetermined signals on variation of the control lever.

In this example, a sensor arrangement 26 is provided on the pump 21 to detect the speed of the pump 21.

The sensor arrangement 26 provides a pump speed feedback signal 28 to a primary comparator 30. The feedback path for the sensor arrangement 26 comprises a first feedback compensation means 32 to modify the first feedback signal 28 as appropriate. The modified first feedback signal 29 is received by the primary comparator 30.

The primary comparator 30 compares the demand signal 23 with the modified first feedback signal 29 and provides a primary control signal 33.

A primary control compensation means 34 is applied to the primary control signal 33 to modify the primary control signal 33. The modified primary control signal is received by a secondary comparator 36.

In this example, the control system 20 also includes a pressure sensor 38 downstream of the pump 21 to sense the pressure of fuel pumped from the pump 21, and provides a pressure feedback signal 40. The pressure sensor 38 comprises a pressure compensation means 42 to provide compensation to the pressure feedback signal 40. The compensated pressure feedback signal 43 is received by the secondary comparator 36.

In this example, a combustion gas sensor 44 is provided downstream of, or in, the combustor 15 to sense conditions of the gases emerging from the combustor 15 and provides a combustion gas feedback signal 46. The combustion gas sensor 44 comprises a combustion gas compensation means 48 to provide compensation to the combustion gas feedback signal 46. The compensated combustion gas feedback signal 49 is received by the secondary comparator 36.

The secondary comparator 36 compares the signals received thereby and provides a secondary control signal 50 for controlling the pump 21. A secondary control signal compensation means 52 provides compensation to the secondary control signal 50 so that it can be utilised by the pump 21.

An example of the operation of the control system will now be discussed. The demand means 22 provides a demand signal 23 for a desired fuel pump speed. The demand signal 23 is transmitted to the pump 21 which delivers an amount of fuel according to its speed. If the speed sensor 26 indicates that the speed of the pump 21 is greater than demanded by the demand means 22, a speed feedback signal 28 to that effect is provided thereby and after the compensation by the compensation means 32, a compensated feedback signal 29 is received by the primary comparator 30. A comparison of the demand signal 23 and the compensated speed feedback signal 29 causes the primary comparator 30 to provide a primary control signal 33 which requires the pump 21 to reduce speed, with a resultant effect on the fuel being supplied. The compensator 34, in this embodiment, includes an integral term to allow the system to settle in steady state conditions.

In addition, a pressure feedback signal 40 is provided by the pressure sensor 38 and in this embodiment, the pressure compensation means 42 provides a modified pressure feedback signal 43 related to the rate of change of pressure. The modified pressure feedback signal 43 is fed to the secondary comparator 36. The secondary comparator 36 combines the compensated primary control signal 37 with the modified pressure feedback signal 43 and provides a secondary control signal 50 adjusted accordingly. Similarly, a combustion gas feedback signal 46 is provided by the combustion gas sensor 44, and in the embodiment shown, the compensation means 48 provides a modified combustor feedback signal 49 relating to the rate of change of combustor conditions. The modified combustor signal 49 is fed to the secondary comparator 36. The secondary comparator 36 combines the modified pressure feedback signal 43 with the modified primary control signal 37, and with the pressure feedback signal 43, if available, and provides a further modification to the secondary control signal 50 for the pump 21 to modulate the flow of fuel pumped thereby.

As can be seen, by continually monitoring the various parameters of the fuel pumped by the pump 21 and the gases produced by the combustor 15, the desired level of fuel pumped by the pump 21 is obtained, whilst achieving a much lower level of variation in pressure conditions at the pump and/or in the combustion system.

Various modifications can be made without departing from the scope of the invention. For example, in a basic system, the pressure sensor 38 and/or the combustion gas sensor 44 could be omitted. The remaining compensation means can then be designed to modify known characteristics of the fuel system, including the pump. Also, the invention may be embodied in any available technology, including combinations of mechanical, electrical, electronic, software, pneumatic and hydraulic technologies. It will be appreciated, therefore, that use of the word "signal" in this specification is not limited to communication by electrical or electronic means.

An example of a system described in the preceding paragraph could be an electric motor driving a fuel pump, which exhibits pulses if a constant electrical torque is applied to the motor. In such a case compensation could be achieved by the use of a mechanical cam arrangement or through appropriate configuration of the motor windings.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A pump control system comprising demand means for providing a demand signal relating to pump speed, a required rate of fluid flow and/or pressure from a pump; sensing means to sense at least one parameter of fluid downstream of the pump and to provide at least one feedback signal relating to the, or each, respective parameter; and comparator means for comparing the demand signal with the at least one feedback signal to provide a control signal to control the pump wherein the comparator means comprises a primary comparator for comparing a first feedback signal with the demand signal and providing a primary control signal, the comparator means further including a secondary comparator for comparing at least one second feedback signal with the primary control signal to provide a secondary control signal.

2. A pump control system according to claim 1, wherein the control signal is determined by the demand signal and the at least one feedback signal.

3. A pump control system according to claim 1, wherein the sensing means comprises a plurality of sensors, each sensing at least one of a respective parameter of the fluid.

4. A pump control system according to claim 1, wherein the secondary comparator compares at least one further feedback signal with the primary control signal and the secondary feedback signal to provide said secondary control signal.

5. A pump control system according to claim 1, wherein the sensing means comprises a sensor arrangement to sense at least one of pump speed, fluid pressure, and the rate of flow of pumped fluid downstream of the pump, the sensor arrangement providing a first feedback signal relating to one of pump speed, the pressure of the fluid and the rate of flow of the fluid.

6. A pump control system according to claim 5, wherein the sensor arrangement comprises a first feedback signal compensation means to render the first feedback signal into a form whereby it can be used by the comparator means.

7. A pump control system according to claim 1, wherein the demand signal provided by the demand means relates to one of the required rate of fluid flow, the required pump speed and to the required fluid pressure.

8. A pump control system according to claim 1, wherein the comparator means comprises a primary comparator to compare the first feedback signal with the demand signal, the primary comparator providing a primary control signal for controlling the pump.

9. A pump control system according to claim 8, wherein the primary comparator subtracts the first feedback signal from the demand signal to provide said primary control signal.

10. A pump control system according to claim 1, wherein the sensing means comprises a pressure sensor to sense the pressure of pumped fluid downstream of the pump, the pressure sensor providing a pressure feedback signal relating to the pressure of the fluid.

11. A pump control system according to claim 10, wherein the pressure sensor comprises a pressure feedback compensation means to provide compensation to the pressure feedback signal to modify the pressure feedback signal and render it into a form whereby it can be used by the comparator.

12. A pump control system according to claim 1, wherein the fluid to be pumped is a fuel, to be combusted in a combustion chamber and produce combustion gases, and the sensing means comprises at least one combustion gas sensor to sense conditions of the combusted gases in, or downstream of, the combustion chamber, the combustion gas sensor providing a combustion gas feedback signal relating to a parameter of the combustion gases.

13. A pump control system according to claim 12, wherein the control system comprises combustion gas feedback compensation means to provide compensation to the combustion gas feedback signal to modify the combustion gas feedback signal and render it into a form whereby it can be used by the comparator.

14. A pump control system according to claim 11, wherein the secondary comparator compares the primary control signal with at least one of the modified pump feedback signal, the secondary comparator providing a secondary control signal for controlling the pump.

15. A pump control system according to claim 14, wherein the secondary comparator subtracts from the primary control signal at least one of the modified pump feedback signal.

16. A pump arrangement, comprising a pump to pump a fluid, and a control system according to claim 1.

17. A pump arrangement according to claim 16, wherein the pump is configured to provide at least one of a characteristic speed, pressure and rate of flow when provided within an input control signal, variations in one of the control signal cause concomitant variations in the speed, pressure and rate of fluid flow pumped from the pump.

18. A method of controlling a pump comprising providing a demand signal relating to one of required speed, pressure rate of fluid flow and pressure from a pump; sensing pump speed or at least one parameter of fluid downstream of the pump and providing at least one feedback signal relating to the each respective parameter; and comparing the demand signal with the at least one feedback signal to provide a control signal to control the pump wherein the method further comprises comparing a first feedback signal with the demand signal and providing a primary control signal, and comparing a second feedback signal with the primary control signal to provide a secondary control signal.

19. A method according to claim 18, wherein the control signal is determined by the demand signal and the, or at least one, feedback signal.

20. A method according to claim 18 comprising sensing one of pump speed and a plurality of parameters of the fluid, and where the system is used in an engine, sensing a plurality of parameters of the engine.

21. A method according to claim 18 comprising comparing at least one further feedback signal with the primary control signal and the secondary feedback signal to provide said secondary control signal.

22. A method according to claim 18 comprising sensing at least one of pump speed, fluid pressure, and the rate of flow of pumped fluid downstream of the pump, and providing a first feedback signal relating to at least one of pump speed, the fluid pressure and the rate of flow of the fluid.

23. A method according to claim 22 comprising modifying the first feedback signal in accordance with the transfer function of the pump to render the first feedback signal into a form whereby the pump provides a desired output.

24. A method according to claim 18, wherein the demand signal relates to the required rate of fluid flow, or to the required pump speed.

25. A method according to claim 18 comprising comparing the first feedback signal with the demand signal, and providing a primary control signal for controlling the pump.

26. A method according to claim 21 comprising subtracting the first feedback signal from the demand signal to provide said primary control signal.

27. A method according to claim 18 comprising sensing the pressure of pumped fluid downstream of the pump, and providing a pressure feedback signal relating to the pressure of the fluid.

28. A method according to claim 27 comprising modifying the pressure feedback signal to render it into a form whereby the transfer function of the pump provides a desired output.

29. A method according to claim 18, wherein the fluid to be pumped is a fuel, to be combusted in a combustion chamber and produce combustion gases, and the method includes the sensing conditions of the combusted gases in, or downstream of, the combustion chamber, and providing a combustion gas feedback signal relating to a parameter of the combustion gases.

30. A method according to claim 29 comprising modifying the combustion gas feedback signal to render it into a form whereby the transfer function of the pump provides a desired output.

31. A method according to claim 28 comparing the primary control signal with the modified pump feedback signal, and providing a secondary control signal for controlling the pump.

32. A method according to claim 31 comprising subtracting from the primary control signal the modified pump feedback signal to provide the secondary control signal.

33. A combustor arrangement comprising a combustor and a pump arrangement according to claim 16.

34. A gas turbine engine incorporating a combustor arrangement according to claim 33.

35. A pump control system according to claim 13, wherein the secondary comparator compares the primary control signal with the modified combustion gas feedback signal, the secondary comparator providing a secondary control signal for controlling the pump.

36. A pump control system according to claim 35, wherein the secondary comparator subtracts from the primary control signal the modified combustion gas feedback signal.

* * * * *